US006162131A

United States Patent [19]

Falzone

[11] Patent Number: 6,162,131

[45] Date of Patent: Dec. 19, 2000

[54] GOLF CLUB OF THE IRON TYPE

[76] Inventor: Peter A. Falzone, P.O. Box 2278, Pensacola, Fla. 32513

[21] Appl. No.: 09/352,936

[22] Filed: Jul. 14, 1999

[51] Int. Cl.[7] ..... A63B 53/04

[52] U.S. Cl. ..... 473/330

[58] Field of Search ..... D21/747, 748, D21/749, 750, 751; 473/324, 330, 331

[56] References Cited

U.S. PATENT DOCUMENTS

| | | |
|---|---|---|
| D. 222,679 | 11/1971 | Gryseels . |
| 626,347 | 6/1899 | Smith . |
| 1,647,487 | 10/1927 | Vernon . |
| 1,673,994 | 6/1928 | Quynn . |
| 2,472,978 | 6/1949 | Mahon . |

FOREIGN PATENT DOCUMENTS

| | | | |
|---|---|---|---|
| 5042 | 1/1890 | United Kingdom | 273/175 |
| 17753 | 7/1894 | United Kingdom | 273/175 |

*Primary Examiner*—Sebastiano Passaniti

[57] ABSTRACT

A golf club head of the iron type known as a wedge is provided which is designed to propel the golf ball short distances or out of the sand in a more efficient manner than the common or conventional type. The striking surface or face of the golf club head includes a curved portion at the rearward portion thereof. The striking surface or face is preferably straight or flat from the leading edge to about one third of the distance back to the trailing or rear edge. At that point the configuration of the striking surface curves upwardly. This upward change in the golf club face or striking surface will throw the ball out of the sand more efficiently than a single straight or flat surface. When used on the fairway or other areas of the golf course it insures a more solid contact with the golf ball when the golfer does not make a perfect or good shot.

6 Claims, 2 Drawing Sheets

GOLF CLUB OF THE IRON TYPE

BACKGROUND OF THE INVENTION

The invention relates to a golf club head of the iron type, and more particularly to such a golf club head that will propel the golf ball out of the sand more efficiently than the common or conventional wedge type golf club head.

The common type of golf club irons are 1–9 irons and wedges. The present invention is directed to a wedge. Wedges have different names. The more common names are pitching, sand and lob. The common or conventional type wedge has a flat or straight face or striking surface. Wedges are golf clubs that are primarily designed for shots of a short distance and for hitting the ball out of the sand. The face or striking surface of the wedge head has a greater loft than other golf club heads. The golf iron head is attached to a shaft and a grip is attached to the other end of the shaft. The wedge head of the present invention is attached to the shaft in the same way as the common or conventional wedge head. The grip also the same. A ferrule may be attached to the shaft if desired. However, the face or striking surface of the wedge head of the present invention is not completely straight or flat as is the case with the common or conventional type.

SUMMARY OF NVENTION

This invention is directed to a golf club head of the iron type comprising a shaft with grip and a head offering all the features of a common or conventional golf iron head except that the striking surface or face of the club head includes an upwardly curving striking surface at least in the rearward portion of the striking surface and which terminates at the trailing edge of the club face. The common or conventional golf iron head has a straight or flat striking surface. The striking surface or face is so designed by changing the angle of the striking surface or face such that the golf ball is propelled from the sand or down the fairway in a more efficient manner than a common or conventional type. The angle of the face of the golf club head is called loft. The common or conventional wedge is designed to slide under the golf ball at impact and throw or blast the golf ball out of the sand along with some sand. Ideally the club face never strikes or hits the ball. It throws the ball out with some sand. The golf club of the present invention does the same except that it embodies a feature which is the crux of the present invention; i.e., the club face includes an upwardly curved portion. The present invention is so designed that the club face or striking surface will slide under the golf ball at impact to start the process of blasting the ball out of the sand trap for part of the distance along the face or striking surface and as the golf club face continues to move forward the ball will then come into contact with the club face or striking surface. By so doing the ball will then be thrown out of the sand more efficiently.

Other aspects of the present invention are discussed hereinafter and will be apparent from the following detailed description taken together with the accompanying drawings.

DETAILED DESCRIPTION OF THE PREFERRED EMBODIMENT

The invention is discussed below in conjunction with the Figures.

Figure 1:
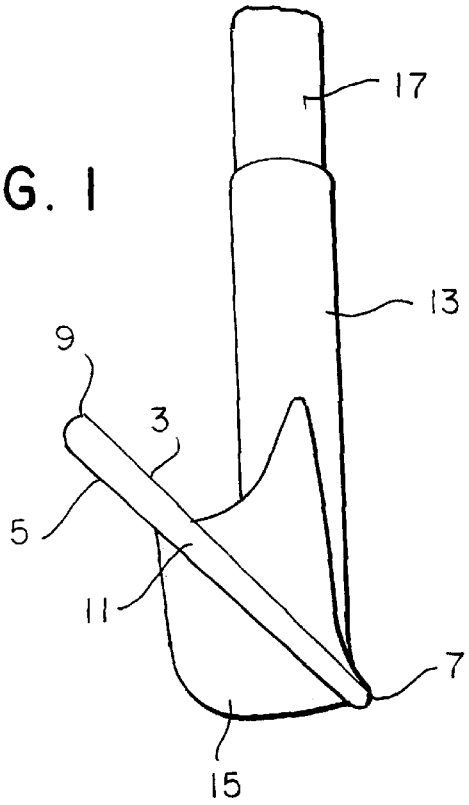
FIG. 1 is a prior art golf iron head (wedge).

FIG. 1 is a common or conventional golf iron wedge head having a flat striking surface or face 3 of the club head, the rear surface 5, the front or leading edge 7, the rear or trailing edge 9, toe 11, hosel 13, lower surface 15 which determines bounce, and the shaft 17. Attached to the upper end of the shaft and not shown is a grip.

Figure 2:
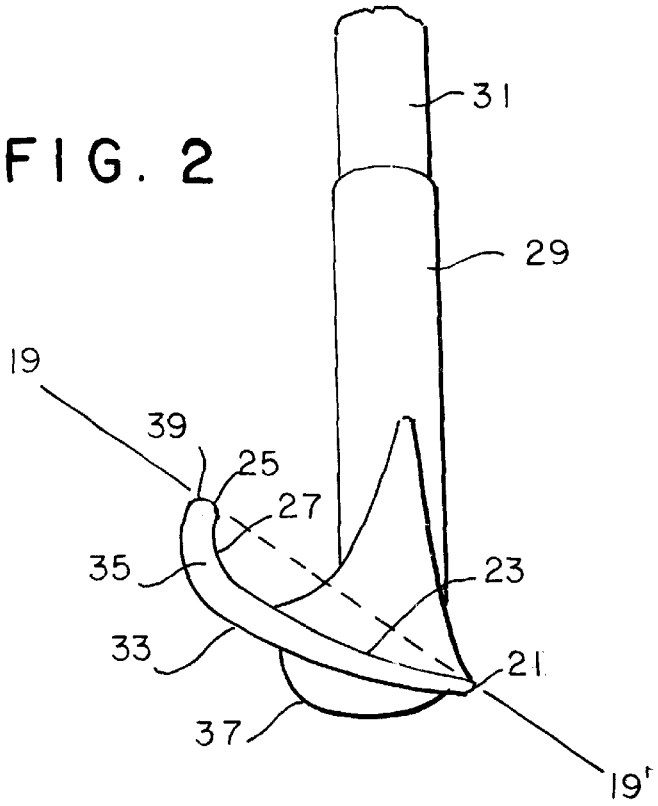
PRIOR ART FIG. 2
FIG. 2 depicts one embodiment of a golf club head of the present invention showing the striking surface or face having a partially straight or flat surface together with an upwardly curving rearward surface.

FIG. 2 depicts one embodiment of the golf iron wedge head of the present invention with 19,19' being a straight line projected across or over the face or striking surface of the club head which illustrates that the face or striking surface is not straight or flat across the entire face or striking surface. As shown in FIG. 2 the face or striking surface of the club head is straight or flat from point 21 to point 23. From point 23 to point 25 the face or striking surface is concave or upwardly curved, with the degree of curvature increasing toward the rearward portion 27 of the club face. In a preferred embodiment, the straight or flat striking surface extends approximately ⅓ to ½ the distance from the leading edge toward the trailing edge.

Preferably, the degree of curvature of the upwardly curving portion is exactly the same as the outer surface of a regulation golf ball which has been approved by the United States Golf Association. The iron club of the present invention will, of course, include hosel 29, shaft 31, rear face 33 of the striking surface of the club head, toe 35, lower surface 37 which determines bounce, rear or trailing edge 39 and front or leading edge 21. Attached to the upper end of the shaft and not shown is a grip.

Figure 3:
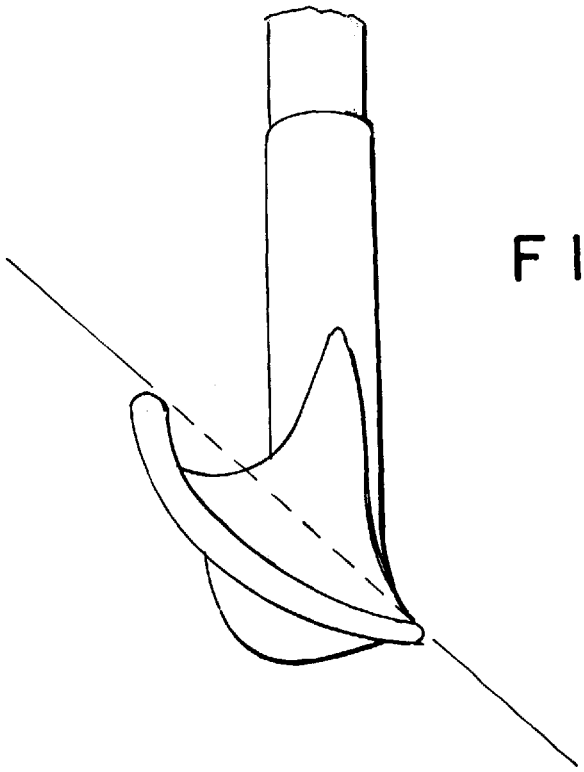
FIG. 3 depicts another embodiment of the golf club head of the present invention showing the face or striking surface as a continuous upwardly curving surface.
Figure 4:
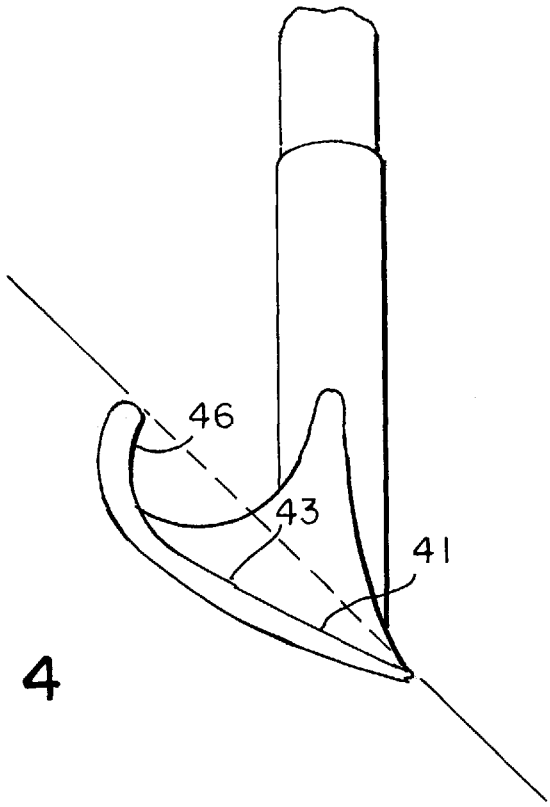
FIG. 4 depicts another embodiment of the golf club head of the present invention showing the striking surface or face having a partially straight or flat surface together with an upwardly curving surface having a more severe curve or rounding at the rear or trailing edge of the upwardly curving face or striking surface.

FIGS. 1 and 2 show the difference between a common or conventional golf iron wedge head and the golf head of the present invention. The primary difference is in the configuration of the striking surface or face of the two golf club heads. The common or conventional head has a continuous straight or flat surface on the face or striking surface of the club head. The present invention does not have a continuous straight or flat surface on the face or striking surface. The face or striking surface of the club head in the present invention has an upwardly curved surface in at least the rearward portion of the striking face. FIG. 3 shows the surface of the club head as part of a circle or rounded shape; i.e., the striking surface has substantially the same radius of curvature from the leading edge portion of the striking surface to the trailing edge of the striking surface. In FIG. 4 leading portion 41 of the face or striking surface of the club head is shown to be initially straight or flat with the rearward portion 43 of the striking surface being curved upwardly. The rearward portion 46 of the striking surface of the embodiment of FIG. 4 has the same degree of curvature as a golf ball which has been approved by the United States Golf Association (USGA) which enhances the ability of the club face to engage the ball. In the embodiment of FIG. 4 the radius of curvature of the upwardly curving surface increases along the striking surface from the leading edge toward the trailing edge. The trailing edge of the upwardly curved striking surface of the club face of FIG. 4 extends upwardly to an extent sufficient to cradle the ball as it moves rearwardly along the striking surface as the ball contacts the club during the swing. This enables the ball to be more easily removed form the sand and lofted into the air. As shown in the Figure, the trailing edge of the upwardly curved striking surface terminates rearwardly of a plane that contains the axis of the club shaft. The above embodiments of the present invention permit the golf ball to be thrown out of the sand more efficiently than the common or conventional iron wedge head.

The angle or loft of the club head of the present invention will vary depending on how far or how high it is desired for the golf ball to travel. The greater the loft the shorter the distance the golf ball will travel. Also, the greater the loft the higher the ball will go. The reverse will happen if you lower the loft. Since the loft in the club head of the present invention becomes smaller as the golf ball travels form the leading edge to the trailing edge of the club face or striking surface, the golf ball will be less lofted than a ball hit by a common or conventional wedge head. However, the club head of the present invention will cause the golf ball to travel slightly farther in a forward direction.

What is claimed is:

1. In a golf iron head of the wedge type comprising a striking surface for making contact with a golf ball, said striking surface having a leading edge and a trailing edge, the improvement wherein at least a part of a forward portion of said striking surface is generally flat and at least a rearward portion of said striking surface curves upwardly whereby an upwardly curving surface is provided terminating at said trailing edge, wherein said upwardly curving surface terminating at said trailing edge has the same radius of curvature as a golf ball which has been approved by the United States Golf Association.

2. The golf iron head of claim 1 wherein said striking surface adjacent said leading edge is flat.

3. The golf iron head of claim 1 wherein the degree of curvature of said striking surface increases when measured from the leading edge of the striking surface toward the rear or trailing edge of the striking surface.

4. In a golf iron head of the wedge type comprising an iron wedge head attached to a shaft, said iron wedge head comprising a striking surface for making contact with a golf ball, said striking surface having a leading edge and a trailing edge, the improvement wherein at least a rearward portion of said striking surface curves upwardly whereby an upwardly curving surface is provided terminating at said trailing edge rearwardly of a plane that contains the shaft axis, and further wherein said upwardly curving surface terminating at said trailing edge has the same radius of curvature as a golf ball which has been approved by the United States Golf Association.

5. The golf iron head of claim 4 wherein said striking surface adjacent said leading edge is flat.

6. The golf iron head of claim 4 wherein the degree of curvature of said striking surface increases when measured from the leading edge of the striking surface toward the trailing edge of the striking surface.

* * * * *